US006010183A

United States Patent [19]

Perkins

[11] Patent Number: 6,010,183

[45] Date of Patent: Jan. 4, 2000

[54] HUNTING SEAT FOR INCLINED SURFACES

[76] Inventor: David Scott Perkins, 252 Deans Rhode Hall Rd., Jamesburg, N.J. 08831

[21] Appl. No.: 09/056,016

[22] Filed: Apr. 7, 1998

[51] Int. Cl.[7] ..... A47C 1/00

[52] U.S. Cl. ..... 297/4

[58] Field of Search ..... 297/4, DIG. 1, 297/440.1, 284.1, DIG. 6; 5/419, 420, 417; 2/102

[56] References Cited

U.S. PATENT DOCUMENTS

| | | | |
|---|---|---|---|
| 1,156,523 | 10/1915 | Clemens . | |
| 1,468,072 | 9/1923 | Ogle . | |
| 2,056,767 | 10/1936 | Blath | 123/132 |
| 2,664,939 | 1/1954 | Besch | 155/37 |
| 2,736,030 | 2/1956 | Moody | 2/94 |
| 3,062,580 | 11/1962 | Jasmin, Jr. . | |
| 3,158,878 | 12/1964 | Pernell | 5/338 |
| 3,185,362 | 5/1965 | Wakefield . | |
| 4,025,105 | 5/1977 | Pekala . | |
| 4,588,224 | 5/1986 | Hill | 297/4 |
| 4,588,244 | 5/1986 | Hill, Jr. . | |
| 4,854,637 | 8/1989 | McCree | 297/188 |
| 4,923,247 | 5/1990 | Malmstrom | 297/4 |
| 4,955,665 | 9/1990 | Richer . | |
| 5,022,107 | 6/1991 | Knotts . | |
| 5,079,790 | 1/1992 | Pouch . | |
| 5,106,155 | 4/1992 | Luehring . | |
| 5,271,659 | 12/1993 | Zinkevicz . | |
| 5,275,315 | 1/1994 | Carmack et al. | 224/151 |
| 5,297,304 | 3/1994 | O'Sullivan | 5/630 |
| 5,310,245 | 5/1994 | Lyszczasz | 297/219.12 |
| 5,317,773 | 6/1994 | Graebe | 5/653 |
| 5,343,876 | 9/1994 | Rogers | 128/170 |
| 5,361,435 | 11/1994 | Reeves . | |
| 5,408,714 | 4/1995 | Lemke | 5/653 |
| 5,487,197 | 1/1996 | Iskra et al. | 5/654 |
| 5,620,227 | 4/1997 | Brune . | |
| 5,625,895 | 5/1997 | Sovereign | 2/467 |

OTHER PUBLICATIONS

Camo–Hunter Advertisement (Undated).

*Primary Examiner*—Milton Nelson, Jr.
*Attorney, Agent, or Firm*—Michael W. Ferrell

[57] ABSTRACT

A hunting seat including a planar cushion provided with a transverse anchor pad is described. The anchor pad it substantially thicker than the cushion so that it secures the position of a user and provides leveling on hilly terrain. Preferably, the anchor pad is detachable.

20 Claims, 4 Drawing Sheets

HUNTING SEAT FOR INCLINED SURFACES

TECHNICAL FIELD

The present invention relates to a hunting seat and more particularly to a hunting seat capable of providing firm anchoring to a user on inclined surfaces and hilly terrain.

BACKGROUND

Much of the prior art relating to cushions and the like exists in the medical area, for example, wheelchair cushions or bed pads for patients undergoing extended convalescence. U.S. Pat. No. 5,487,197 describes a pneumatic wheelchair cushion with adjoining chambers, while U.S. Pat. No. 5,343,876 shows a modular pad which can be specifically adapted to relieve the ischial tuberosity and the coccyx. U.S. Pat. No. 5,317,773 is directed to a waterblown foam base with a flat seat portion and a raised front portion generally defining a pommel, centrally located. So, also, U.S. Pat. No. 5,310,245 discloses a pad to be used in connection with a car-seat for an infant. The pad of the '245 patent has cylindrical support means to support the head of a baby. In one embodiment, the cylindrical support means are formed by rolling up the pad. Likewise, U.S. Pat. No. 5,297,304 illustrates a pad that can be rolled up to provide support as desired. Further illustration of various aspects of the prior art may be found in U.S. Pat. Nos.: 5,079,790; 3,158,878; 2,056,767; 1,468,072 and 1,156,523.

Cushions have also been specifically designed for sporting use, for example a product called CAMO-HUNTER by Therm-a-Seat marketed by Northeast Products, Methuen, Mass. is reportedly made of close-cell foam and includes a Velcro® belt strap. U.S. Pat. No. 5,625,895 shows a pad to be worn about the waist of a user and includes a utility pocket. Also noteworthy sport cushions can be seen in U.S. Pat. Nos.: 5,408,714; 5,275,315; 4,923,247; 4,854,637; 4,588,224; 4,025,105; 2,736,030 and 2,664,939.

SUMMARY OF INVENTION

There is provided in accordance with the present invention a hunting seat to be worn about the waist of a user. The hunting seat includes a planar cushion and attached thereto a transverse anchor portion to provide stability and leveling on inclined or hilly terrain. The cushion is readily deformed by the weight of a user so as to conform to the surface, while the transverse anchor portion is at least about 1.5 times thicker than the cushion so that it frictionally engages the surface of the ground and provides a relatively stable, level seat to the user.

BRIEF DESCRIPTION OF DRAWINGS

The invention is described in detail below in connection with various drawings wherein corresponding parts are numbered similarly (and 100 numerals higher for convenience in FIGS. 7 and 8). In the drawings.

DETAILED DESCRIPTION

Figure 1:
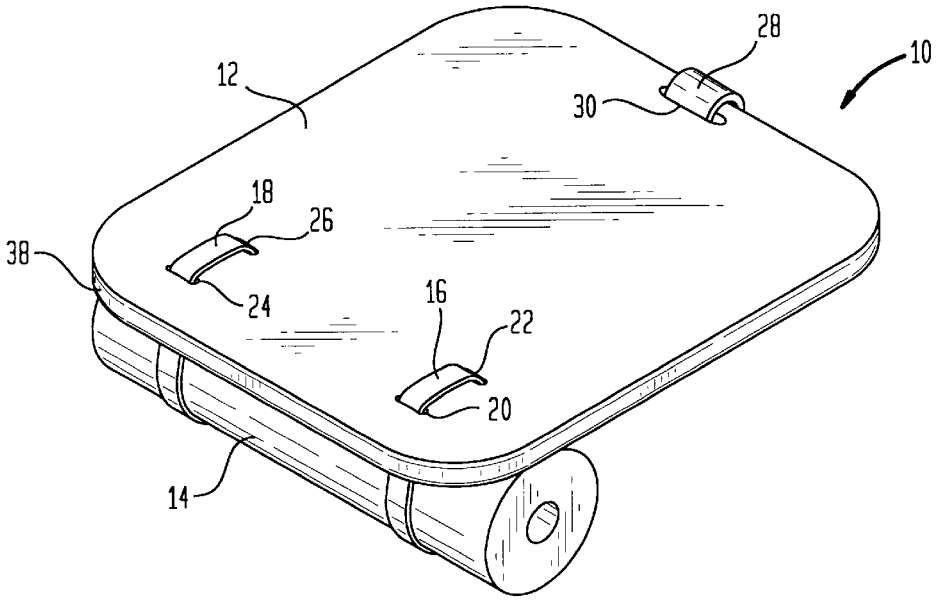
FIG. 1 is a view in perspective of the inventive hunting seat.

There is shown in FIG. 1 a perspective view of a first embodiment of a hunting seat 10 constructed in accordance with the present invention. The hunting seat includes a planar cushion portion 12 as well as a transverse anchor member 14 attached with straps 16, 18 which pass about the anchor member and through slots 20, 22, 24, and 26. The anchor member is thus detachably secured to the cushion. The straps may be provided with buckles if so desired, or more preferably be provided with VELCRO® fastener portions which serve to fasten them. Planar cushion 12 is made of a polymer foam and may be flat or scalloped if so desired. Preferred materials are elastomeric foams so that the cushion is flexible and will readily deform upon application of the weight of a user. Particularly preferred materials are closed-cell elastomeric urethane foams and closed-call elastomeric polyester foams. Generally, cushion 12 is rectangular as shown and is wide enough, that is the lateral dimension is long enough to extend over the entire seat of a user.

An additional strap, 28, is provided through another slot 30 in cushion 12 in order to attach the hunting seat to the belt of a user.

Figure 2:
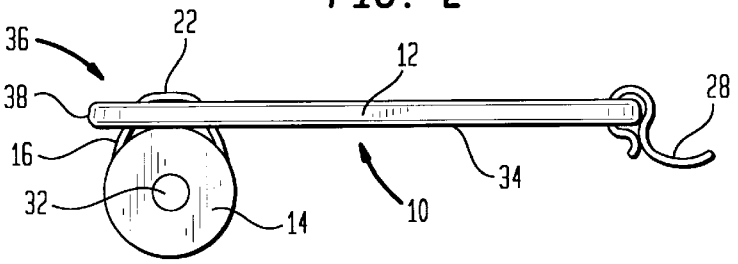
FIG. 2 is a view in elevation of the hunting seat of FIG. 1.

FIG. 2 is a view in elevation of hunting seat 10 wherein the relative dimensions of the seat can be more readily appreciated. The planar cushion member 12 is typically from about ¼ inch to 2 inches in thickness. As noted, the cushion may be scalloped but is more typically simply of uniform thickness. Anchor member 14 is shown in FIG. 2 to be cylindrical with a central cavity 32 along its longitudinal axis. The anchor may also be of other shapes and is made of a polymer foam preferably of the type generally used to make cushion 12; particularly preferred materials being closed-cell elastomeric polymer foams of either elastomeric polyurethane or elastomeric polyester. Anchor 14 has a diameter at least 1.5 times the thickness of cushion 12. More preferably the thickness of anchor member is a least twice the thickness of cushion 12 and even more preferably at least three or at least four times the thickness of the cushion. In connection with a cylindrical anchor member, the thickness referred to is the diameter of the cylinder. If another profile is used for the anchor, the thickness of the anchor referred to herein is the thickness of the anchor in the direction perpendicular to the outer surface 34 of the hunting seat. Anchor 14 extends across the entire transverse direction of the rectangular cushion 12 at the lower extremity 36 of cushion 12 substantially parallel to edge 38 thereof as can be seen in FIG. 1 and FIG. 2.

Figure 3:
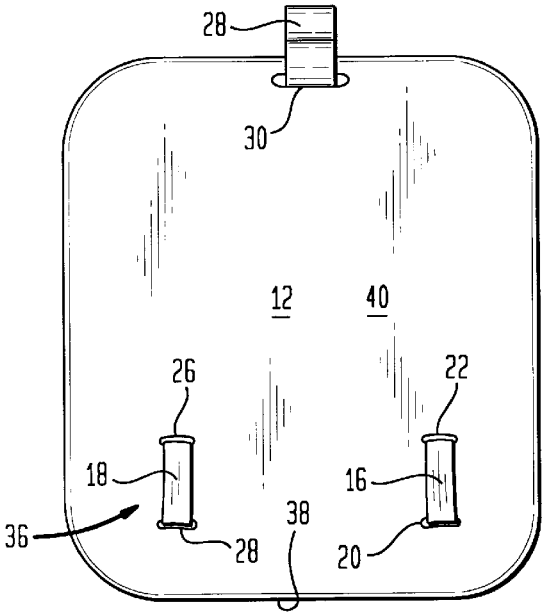
FIG. 3 is a top plan view of the hunting seat of FIG. 1.
Figure 4:
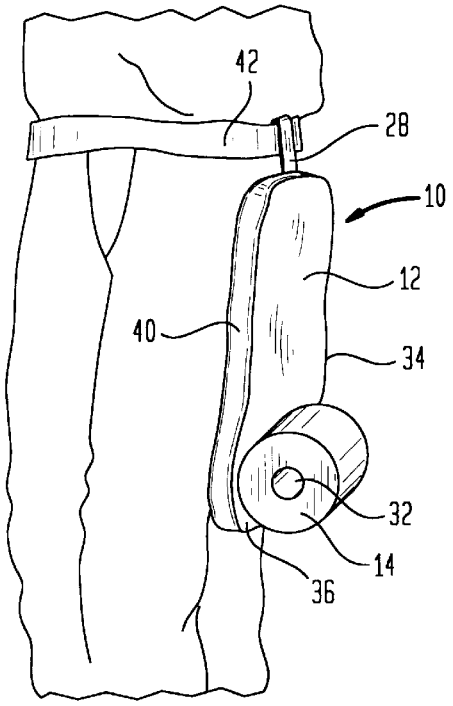
FIG. 4 and FIG. 5 are illustrations of the inventive hunting seat fastened about the waist of a wearer.
Figure 5:
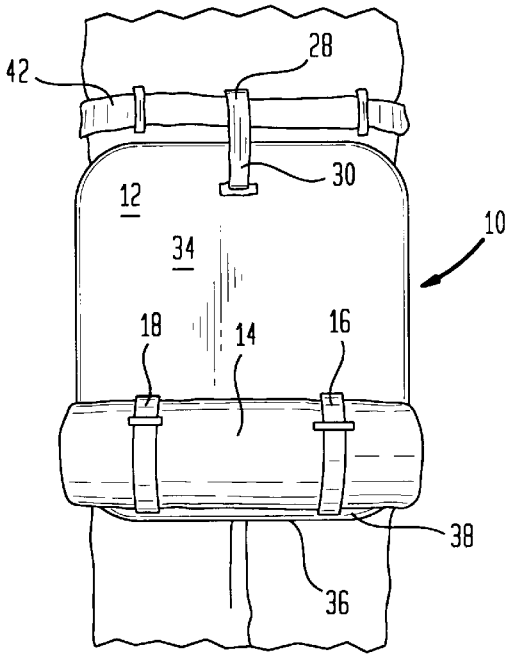

FIG. 3 is a plan view of the inner surface 40 of the hunting seat shown in FIGS. 1 and 2. When in use, the seat 10 is worn such that surface 40 is adjacent the wearer, as shown in FIGS. 4 and 5. Seat 10 is suspended by way of strap 28 from a belt 42 of a user such that lower extremity 36 is above knee level and below the buttocks. Anchor member 14 is thus between knee level and the level of the buttocks as can be seen. In FIG. 4, straps 16, 18 are shown with buckles for holding anchor member 14 in its appropriate position near edge 36.

Figure 6:
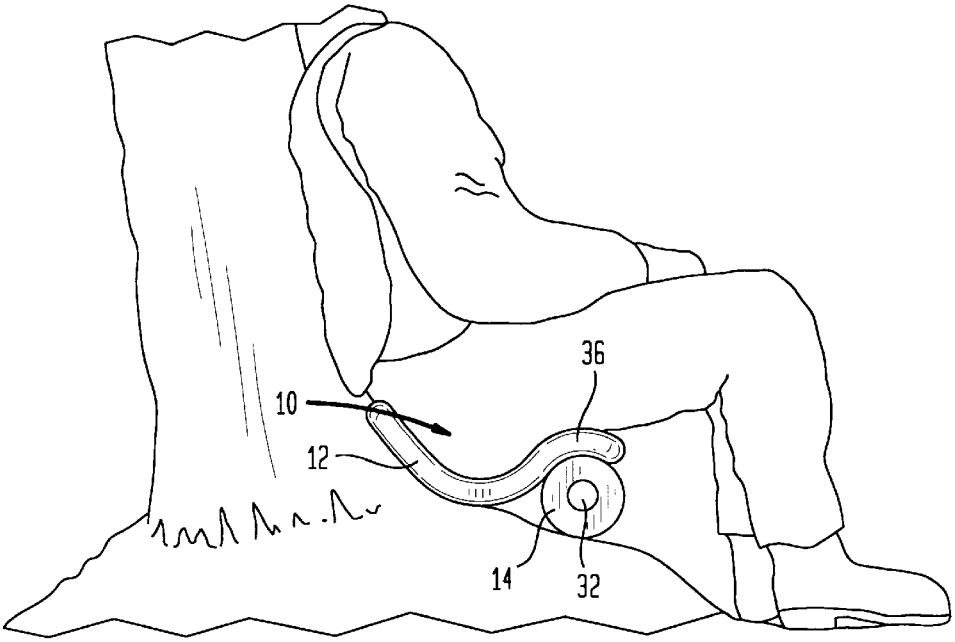
FIG. 6 is an illustration of a hunting seat of the present invention being utilized on an inclined surface.

FIG. 6 illustrates operation of the hunting seat. Cushion 12 is readily deformed by the weight of a user to conform to the contours of the ground. Anchor member 14 frictionally engages the ground and provides a leveling effect. The user will thus be prevented from sliding down an inclined surface. Member 14 is sufficiently stiff so that it will not completely deform and will provide the requisite elevation. Typically, anchor member 14 will retain at least about 90 percent of its thickness under the weight of a user so that the anchor member remains functional to elevate extremity 36 of seat 10.

Figure 7:
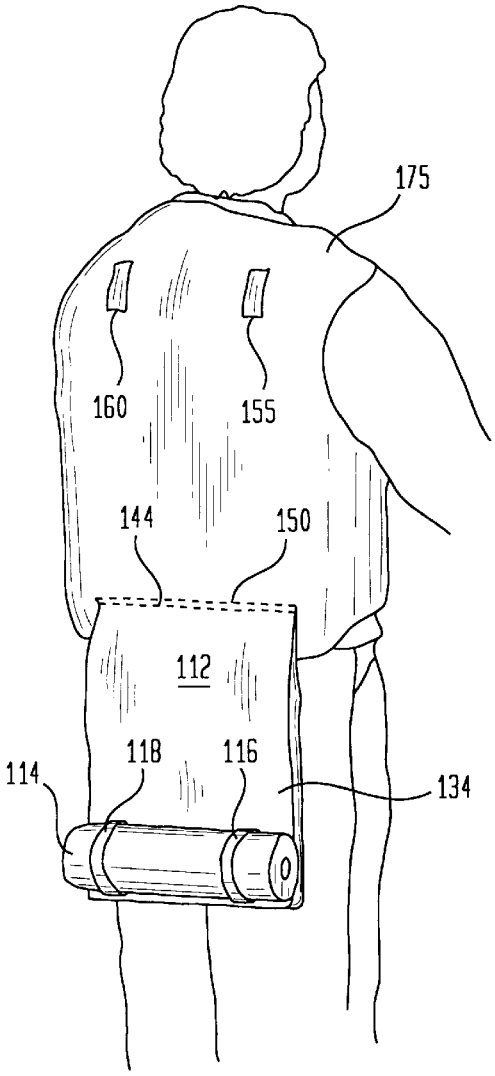
FIG. 7 is an illustration of a further embodiment of a hunting seat according to the present invention.
Figure 8:
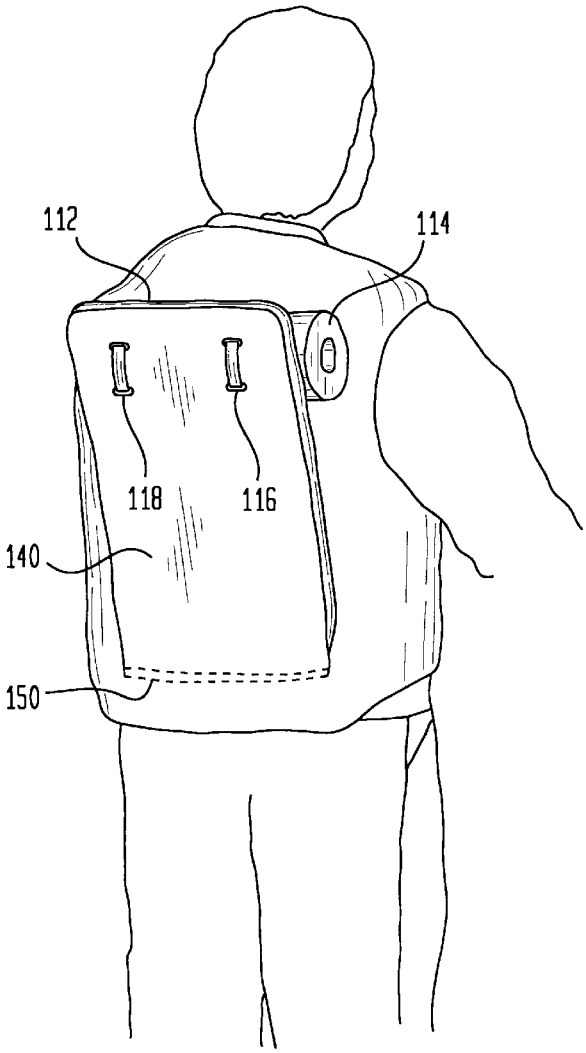
FIG. 8 is a view of the hunting seat of FIG. 7 wherein the seat has been folded upwardly upon the back of a wearer.

There is shown in FIG. 7 an alternate embodiment of the inventive hunting seat. In this embodiment the user dons a vest 175 wherein cushion 112 is stitched onto the vest as indicated at 150, along the entire upper edge 144 of the rectangular cushion 112. When cushion 112 is suspended downwardly from the stitching indicated at 150, anchor member 114 is above knee level and below the buttocks as shown while outer surface 134 faces away from the user. Straps 118, 116 are preferably VELCRO® fastener material adapted to fasten onto retaining patches 155, 160. The hunting seat can thus be folded upwardly onto the back of a user by way of straps 116, 118 fastening onto patches 155, 160 as shown in FIG. 8. When so positioned, the inner surface 140 faces away from the user and the seat does not interfere with movement.

Figure 9:
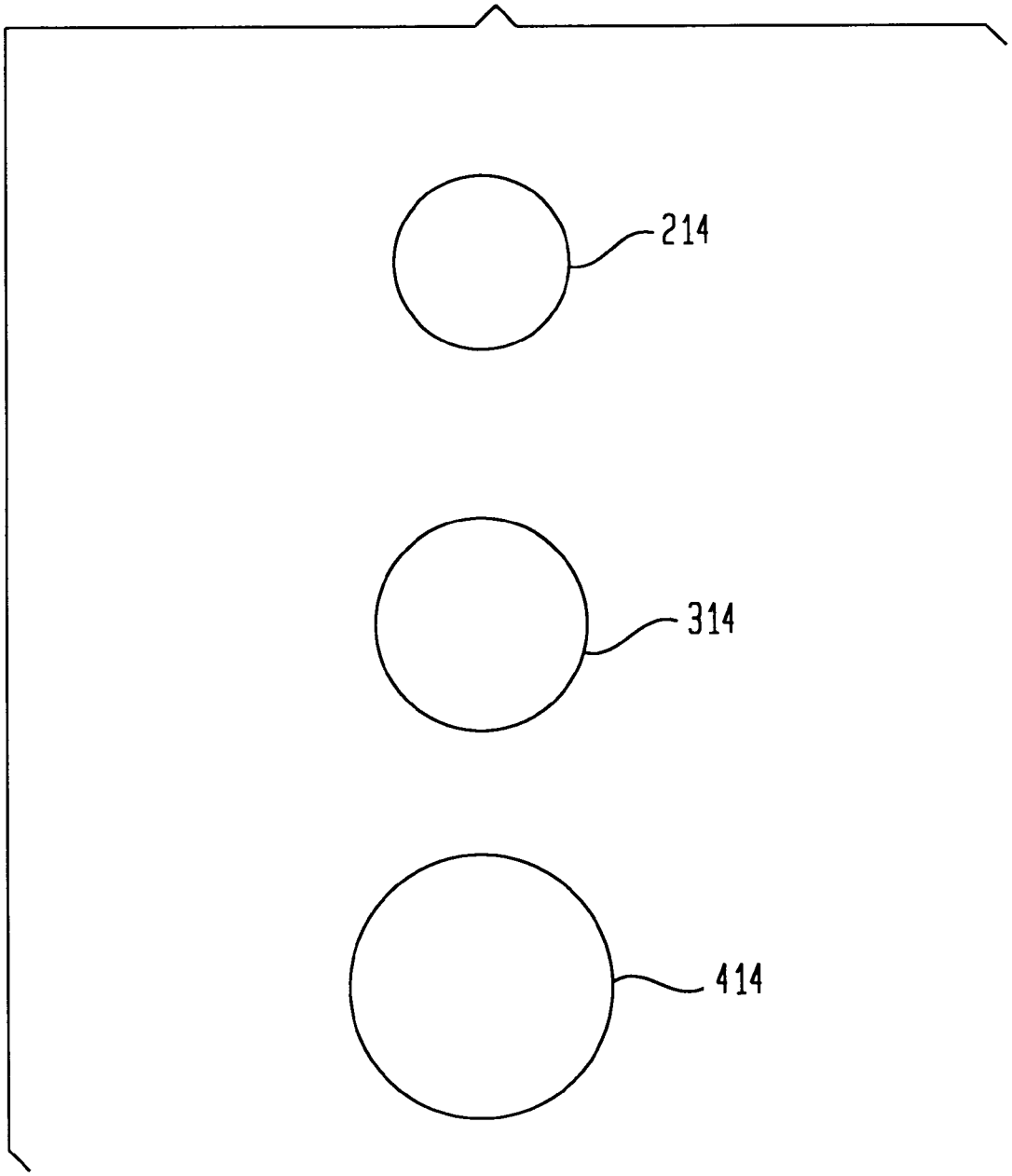
FIG. 9 is a view in elevation of three different cylindrical members useful in connection with the hunting seat of the present invention.

There are shown in FIG. 9 three cylinders 214, 314 and 414 as seen from an end thereof. The cylinders range in diameter (thickness) from about 3 to about 6 times the thickness of cushion portion 12, that is, the diameter of cylinder 214 is 3 times the thickness of cushion 12, the diameter of cylinder 314 is about 4.5 times the thickness of cushion 12 and the diameter of cylinder 414 is about 6 times the length of cushion 12. Any one of cylinders 214, 314 or 414 is of suitable length so it may be substituted for cylinder 14 of FIG. 1. In this way, the hunting seat can be adjusted to suit the preference of the wearer and to be more suitable for the particular terrain involved. The cylinders are so attached one at a time, or in other words, exclusively attached depending on the degree of leveling desired.

The invention has been described above for purposes of exemplification only. Numerous modifications may be made within the spirit and scope of the present invention which is limited and defined by the appended claims.

I claim:

1. A hunting seat for use on an inclined surface comprising:

(a) a flexible and planar cushion member formed of a polymer foam, which foam is readily deformable upon application of a user's weight, said cushion having an inner and outer surface and upper and lower extremities;

(b) means for attaching said cushion member about a waist of said user such that said cushion member is rearwardly disposed with respect to said user, said cushion member being adapted and dimensioned to be worn suspended about a seat of said user such that said inner surface thereof is adjacent the body of the user and the outer surface thereof is facing away from the user, opposite the seat of said user; and (c) a transverse anchor member formed of a polymer foam attached to the outer surface of said cushion member at a lower extremity thereof, said transverse anchor member extending across substantially the entire width of said cushion member and being substantially parallel to the lower edge thereof, said anchor member having a thickness of at least 1.5 times the thickness of the cushion member such that it is adapted to frictionally engage said inclined surface and provide a levelling effect when said hunting seat is in use as such.

2. The hunting seat according to claim 1, wherein said anchor member has a thickness of at least 4 times the thickness of the cushion member.

3. The hunting seat according to claim 1, wherein said anchor member is detachably secured to said cushion member.

4. The hunting seat according to claim 1, wherein said anchor member is cylindrical.

5. The hunting seat according to claim 1, wherein said cushion member is formed of a polyurethane foam.

6. The hunting seat according to claim 1, wherein said anchor member has a thickness of at least twice the thickness of the cushion member.

7. The hunting seat according to claim 6, wherein said anchor member has a thickness of at least 4 times the thickness of the cushion member.

8. The hunting seat according to claim 1, wherein said cushion member is formed of a closed-cell polymer foam.

9. The hunting seat according to claim 8, wherein said anchor member is formed of a closed-cell polymer foam.

10. The hunting seat according to claim 8, wherein said cushion member is formed of a polyurethane foam.

11. A hunting seat for use on an inclined surface comprising:

(a) a flexible and planar cushion member formed of a polymer foam, which foam is readily deformable upon application of a user's weight, said cushion having an inner and outer surface and upper and lower extremities;

(b) means for attaching said cushion member about a waist of said user such that said cushion member is rearwardly disposed with respect to said user, said cushion member being adapted and dimensioned to be worn suspended about a seat of said user such that said inner surface thereof is adjacent the body of the user and the outer surface thereof is facing away from the user, opposite the seat of said user; and (c) a transverse anchor member formed of a polymer foam attached to the outer surface of said cushion member at a lower extremity thereof, said transverse anchor member extending across substantially the entire width of said cushion member and being substantially parallel to the lower edge thereof, said anchor member having a thickness of at least 1.5 times the thickness of the cushion member such that it is adapted to frictionally engage said inclined surface and provide a levelling effect when said hunting seat is in use as such; and (d) means for securing said cushion member on a back of a user whereby said outer surface of said cushion member is located adjacent to the back of a user and said cushion is folded upwardly away from the seat of said user.

12. The hunting seat according to claim 11, wherein said means for attaching said cushion member about said waist of said user and said means for securing said cushion member on a back of a user are both located on a vest.

13. The hunting seat according to claim 11, wherein said anchor member has a thickness of at least twice the thickness of the cushion member.

14. The hunting seat according to claim 11, wherein said anchor member has a thickness of at least thrice the thickness of the cushion member.

15. The hunting seat according to claim 11, wherein said anchor member has a thickness of at least 4 times the thickness of the cushion member.

16. The hunting seat according to claim 11, wherein said anchor member is detachably secured to said cushion member.

17. The hunting seat according to claim 11, wherein said anchor member is cylindrical.

18. The hunting seat according to claim 11, wherein said anchor member is formed of closed-cell polymer foams.

19. The hunting seat according to claim 18, wherein said cushion member is formed of a polyurethane foam.

20. A kit for making a hunting seat for use on an inclined surface comprising:

(a) a flexible and planar cushion member formed of a polymer foam, which foam is readily deformable upon application of a user's weight, said cushion having an inner and outer surface and upper and lower extremities;

(b) means for attaching said cushion member about a waist of said user such that said cushion member is rearwardly disposed with respect to said user, said cushion member being adapted and dimensioned to be worn suspended about the seat of said user such that said inner surface thereof is adjacent the body of the user and the outer surface thereof is facing away from the user, opposite the seat of said user; and (c) a first detachable transverse anchor member formed of a polymer foam attached to the outer surface of said cushion member at the lower extremity thereof, said transverse anchor member extending across substantially the entire width of said cushion member and being substantially parallel to the lower edge thereof, said anchor member having a thickness of at least 1.5 times the thickness of the cushion member such that it is adapted to frictionally engage said inclined surface and provide a levelling effect when said hunting seat is in use as such; and (d) a plurality of additional detachable transverse anchor members formed of polymer foam which may be substituted for said first detachable transverse anchor member.

* * * * *